US009856760B2

(12) United States Patent
Chiba et al.

(10) Patent No.: US 9,856,760 B2
(45) Date of Patent: Jan. 2, 2018

(54) VALVE TIMING CONTROL APPARATUS

(71) Applicant: DENSO CORPORATION, Kariya, Aichi-pref. (JP)

(72) Inventors: Tomonari Chiba, Kariya (JP); Shinsuke Ido, Kariya (JP)

(73) Assignee: DENSO CORPORATION, Kariya (JP)

( * ) Notice: Subject to any disclaimer, the term of this patent is extended or adjusted under 35 U.S.C. 154(b) by 11 days.

(21) Appl. No.: 15/175,422

(22) Filed: Jun. 7, 2016

(65) Prior Publication Data

US 2016/0369662 A1 Dec. 22, 2016

(30) Foreign Application Priority Data

Jun. 17, 2015 (JP) ..... 2015-121645

(51) Int. Cl.
*F01L 1/34* (2006.01)
*F01L 1/344* (2006.01)

(52) U.S. Cl.
CPC ... *F01L 1/3442* (2013.01); *F01L 2001/34453* (2013.01); *F01L 2001/34469* (2013.01)

(58) Field of Classification Search
CPC ..... F01L 1/344; F01L 1/3442; F01L 2001/34469; F01L 2001/34453
USPC ..... 123/90.17
See application file for complete search history.

(56) References Cited

U.S. PATENT DOCUMENTS

2003/0200944 A1* 10/2003 Takahashi ..... F01L 1/3442 123/90.15

FOREIGN PATENT DOCUMENTS

JP 3033582 2/2000

* cited by examiner

*Primary Examiner* — Zelalem Eshete
(74) *Attorney, Agent, or Firm* — Nixon & Vanderhye PC

(57) ABSTRACT

A vane rotor is rotatably placed in an inside of a housing. A lock pin, which is placed in an inside of a receiving hole of the vane rotor, is insertable into a fitting hole formed in a rear plate. A second pressure chamber formed in the fitting hole is communicated with an advancing chamber. An air discharge hole communicates between the second pressure chamber and the atmosphere in a state where the lock pin is inserted into the fitting hole. The air discharge hole blocks communication between the second pressure chamber and the atmosphere in a state where the lock pin is removed from the fitting hole.

6 Claims, 9 Drawing Sheets

RETARDING DIRECTION
ADVANCING DIRECTION
10
II
28
30
60
63
53
51
50
19
11, 14
15
56
18
52
54
55
22
53
50
51
26
18
56
15
54
52
55
22
53
20, 21
50
51
56
18
52
54
55
22
53
50
51
56
15
54
52
55
22
53
50
51
56
18
15
54
55
22
53
50
51
56
18
15
54
55
22
53
50
51
56
18
15
54

VALVE TIMING CONTROL APPARATUS

CROSS REFERENCE TO RELATED APPLICATION

This application is based on and incorporates herein by reference Japanese Patent Application No. 2015-121645 filed on Jun. 17, 2015.

TECHNICAL FIELD

The present disclosure relates to a valve timing control apparatus.

BACKGROUND

A known valve timing control apparatus is installed in a drive force transmission system, which transmits a drive force from a crankshaft (serving as a drive shaft) of an internal combustion engine to a camshaft (serving as a driven shaft) that opens and closes intake valves or exhaust valves.

The valve timing control apparatus includes a housing and a vane rotor. The housing is rotated when the drive force of the crankshaft is transmitted to the housing. The vane rotor is rotatable relative to the housing and is fixed to the camshaft. The vane rotor partitions each of oil pressure chambers formed in an inside of the housing into an advancing chamber and a retarding chamber. When the oil, which is pumped by an oil pump, is supplied to one of the advancing chamber and the retarding chamber in each corresponding oil pressure chamber through one of two oil passages (one of two oil passage systems) formed in the engine side, the oil, which is accumulated in the other one of the advancing chamber and the retarding chamber, is returned to an oil pan through the other one of the oil passages. In this way, in the valve timing control apparatus, the vane rotor is rotated relative to the housing to change the relative rotational phase between the crankshaft and the camshaft to adjust the opening timing and the closing timing of the intake valves or the exhaust valves.

In the valve timing control apparatus, due to a resilient force of a spring, which urges the intake valve or the exhaust valve driven by the camshaft in a valve closing direction, a cam torque, which swings the vane rotor fixed to the camshaft in a retarding direction or an advancing direction, is exerted.

In view of the above point, a valve timing control apparatus recited in JP3033582B2 has a lock pin that limits relative rotation between the housing and the vane rotor. When the oil pressure is low at the time of starting the engine, the lock pin is received in a receiving hole of a vane rotor and is inserted into a fitting hole formed in the housing. In this way, the lock pin can limit collision between the housing and the vane rotor caused by the cam torque transmitted from the camshaft, and thereby generation of noise (hitting sound) can be limited.

After the starting of the engine, when the oil pressure is supplied to a pressure chamber formed in the fitting hole of the lock pin, the lock pin is removed from the fitting hole. Thereby, in the valve timing control apparatus, the relative rotation between the housing and the vane rotor is enabled.

The inventors of the present application have found occurrence of the following disadvantage in a state where the engine side oil passage is nearly clogged upon increasing of the viscosity of the oil under an extremely low temperature, or a state where the engine side oil passage is clogged by, for example, a foreign object.

That is, at the time of engine stop, the two oil passages (two oil passage systems), which connect between the oil pump of the engine and the valve timing control apparatus, as well as the retarding chambers and the advancing chambers of the valve timing control apparatus are filled with the air. In a case where the valve timing control apparatus adjusts the valve timing (the opening timing and closing timing) of the intake valves, the oil is supplied from the oil pump to the retarding chambers through one of the oil passages at the time of engine start. At this time, the air, which is accumulated in the one of the oil passages, is conducted to the advancing chambers and the pressure chamber of the lock pin after passing through a gap between the housing and the vane rotor. At this time, when the other one of the oil passages, which discharges the oil from the advancing chambers in the normal time, is clogged or nearly clogged, the air in the advancing chambers and the air in the pressure chamber are not discharged. Thus, a gas pressure of the pressure chamber is increased to possibly cause release of the lock pin. In such a case, the housing and the vane rotor cannot be fixed to each other. Thus, collision repeatedly occurs between the vane rotor and the housing to generate the noise (hitting sound).

In another case where the valve timing control apparatus adjusts the valve timing of the exhaust valves instead of the intake valves, the relationship between the retarding chambers and the advancing chambers discussed above may be reversed to understand the mechanism of generating the noise.

SUMMARY

The present disclosure is made in view of the above disadvantage. According to the present disclosure, there is provided a valve timing control apparatus that changes relative rotational phase between a drive shaft of an internal combustion engine and a driven shaft to adjust opening timing and closing timing of an intake valve or an exhaust valve, which is opened and closed by the driven shaft that is driven by the drive shaft. The valve timing control apparatus includes a housing, a vane rotor, a lock pin, at least one pressure chamber and an air discharge hole. The housing includes a front plate, a rear plate and a peripheral wall. The rear plate is opposed to the front plate. The peripheral wall connects between the front plate and the rear plate. The housing is rotated when a drive force of the drive shaft is conducted to the housing. The vane rotor includes a rotor and a vane. The rotor is fixed to the driven shaft. The vane outwardly projects in a radial direction from the rotor and partitions an oil pressure chamber formed in an inside of the housing into an advancing chamber and a retarding chamber. The vane rotor is rotatable relative to the housing. The lock pin is reciprocatable in an axial direction in an inside of a receiving hole, which extends through the vane rotor in the axial direction. The lock pin is insertable into a fitting hole, which is formed in one of the front plate and the rear plate. The at least one pressure chamber is communicated with the advancing chamber or the retarding chamber and receives an oil pressure that applies a force to the lock pin in a removing direction that is a direction for removing the lock pin from the fitting hole. At least a portion of the air discharge hole is formed in the lock pin. The air discharge hole communicates between the at least one pressure chamber and an atmosphere in a state where the lock pin is inserted into the fitting hole. The air discharge hole blocks communication between the at least one pressure chamber and the atmosphere in a state where the lock pin is removed from the fitting hole.

BRIEF DESCRIPTION OF THE DRAWINGS

The drawings described herein are for illustration purposes only and are not intended to limit the scope of the present disclosure in any way.

DETAILED DESCRIPTION

Figure 1:
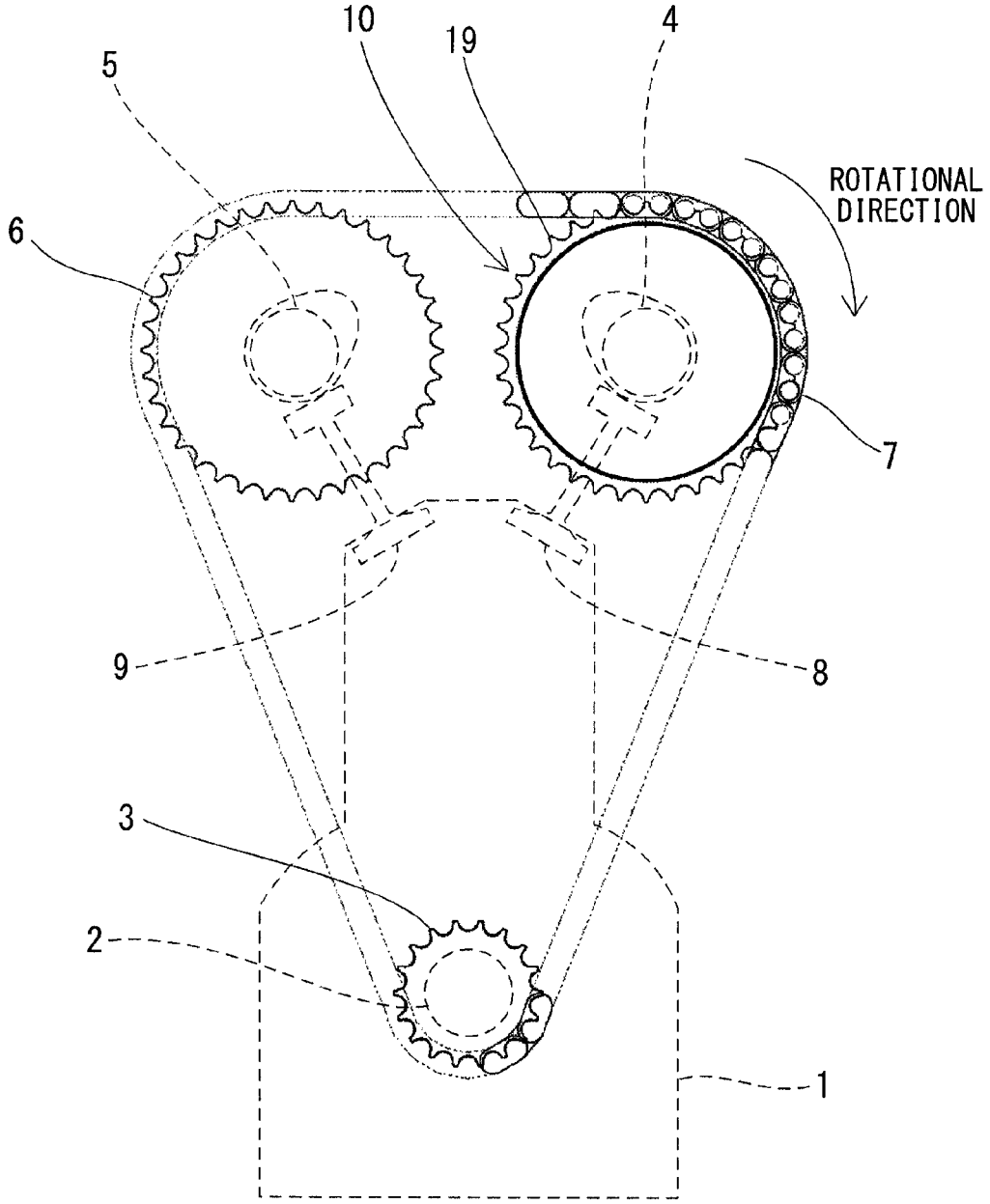
FIG. 1 is a schematic diagram showing a drive force transmission system, in which a valve timing control apparatus of a first embodiment of the present disclosure is installed.

Various embodiments of the present disclosure will be described with reference to the accompanying drawings. In a case where a plurality of substantially identical structures is depicted in the drawing(s), only some of the substantially identical structures will be indicated with a corresponding reference sign.

First Embodiment

FIGS. 1 to 5 show a first embodiment of the present invention. A valve timing control apparatus 10 of the present embodiment is installed in a drive force transmission system shown in FIG. 1. In the drive force transmission system, a chain 7 is wound around a gear 3, which is fixed to a crankshaft (serving as a drive shaft) 2 of an internal combustion engine 1, a gear 6, which is fixed to a camshaft (serving as a driven shaft) 5, and a gear 19, which is fixed to a camshaft (serving as a driven shaft) 4, so that a torque is transmitted from the crankshaft 2 to the camshafts 4, 5 upon rotation of the crankshaft 2. The camshaft 4 drives intake valves 8, and the camshaft 5 drives exhaust valves 9. In the valve timing control apparatus 10 of the present embodiment, the gear 19 is connected to the chain 7, and a vane rotor 20 is connected to the camshaft 4. The crankshaft 2 and the camshaft 4 are rotated with a predetermined phase difference therebetween to adjust opening timing and closing timing of the intake valves 8.

Figure 2:
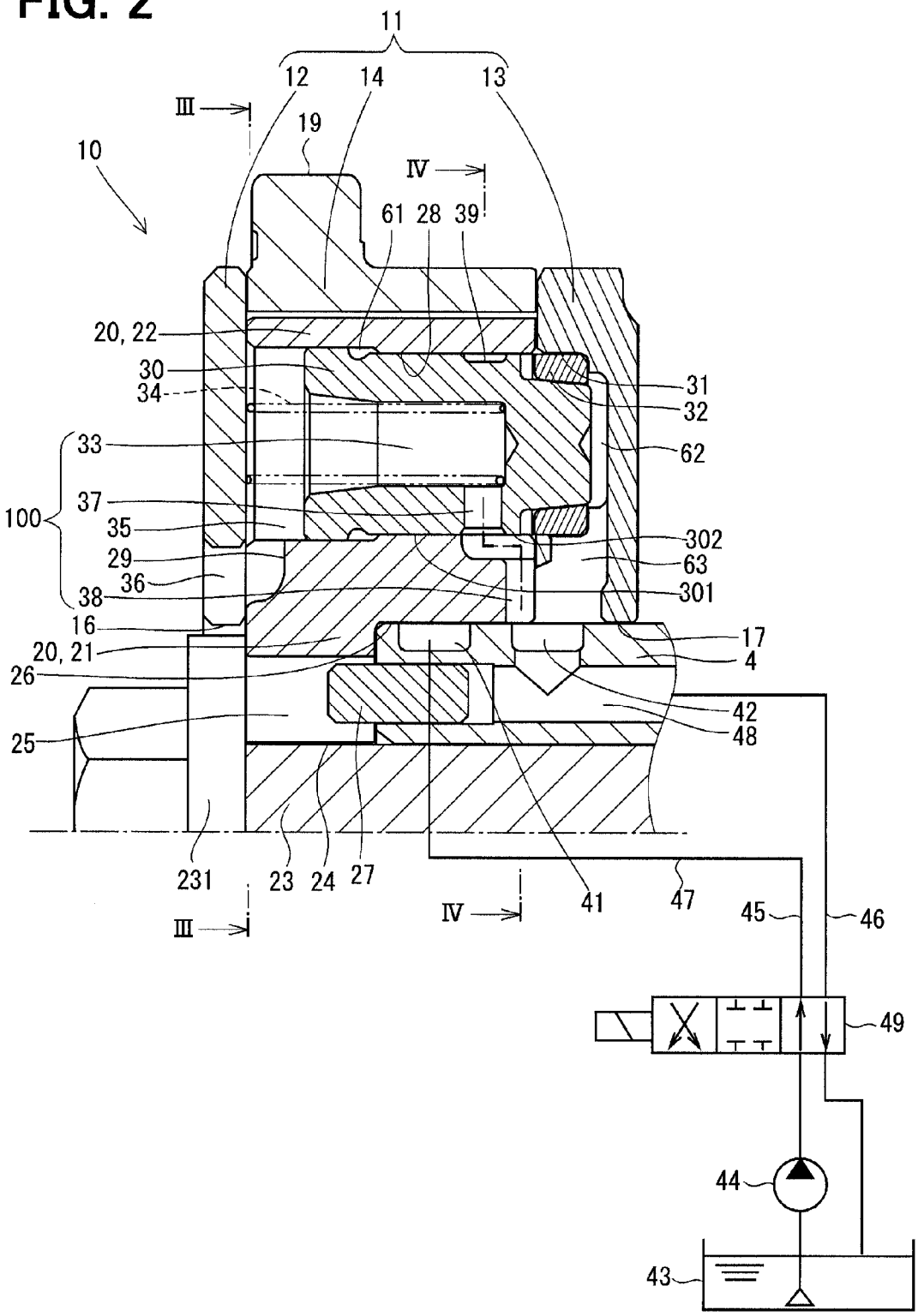
FIG. 2 is a cross-sectional view of the valve timing control apparatus according to the first embodiment, showing a lock pin inserted into a fitting hole.
Figure 3:
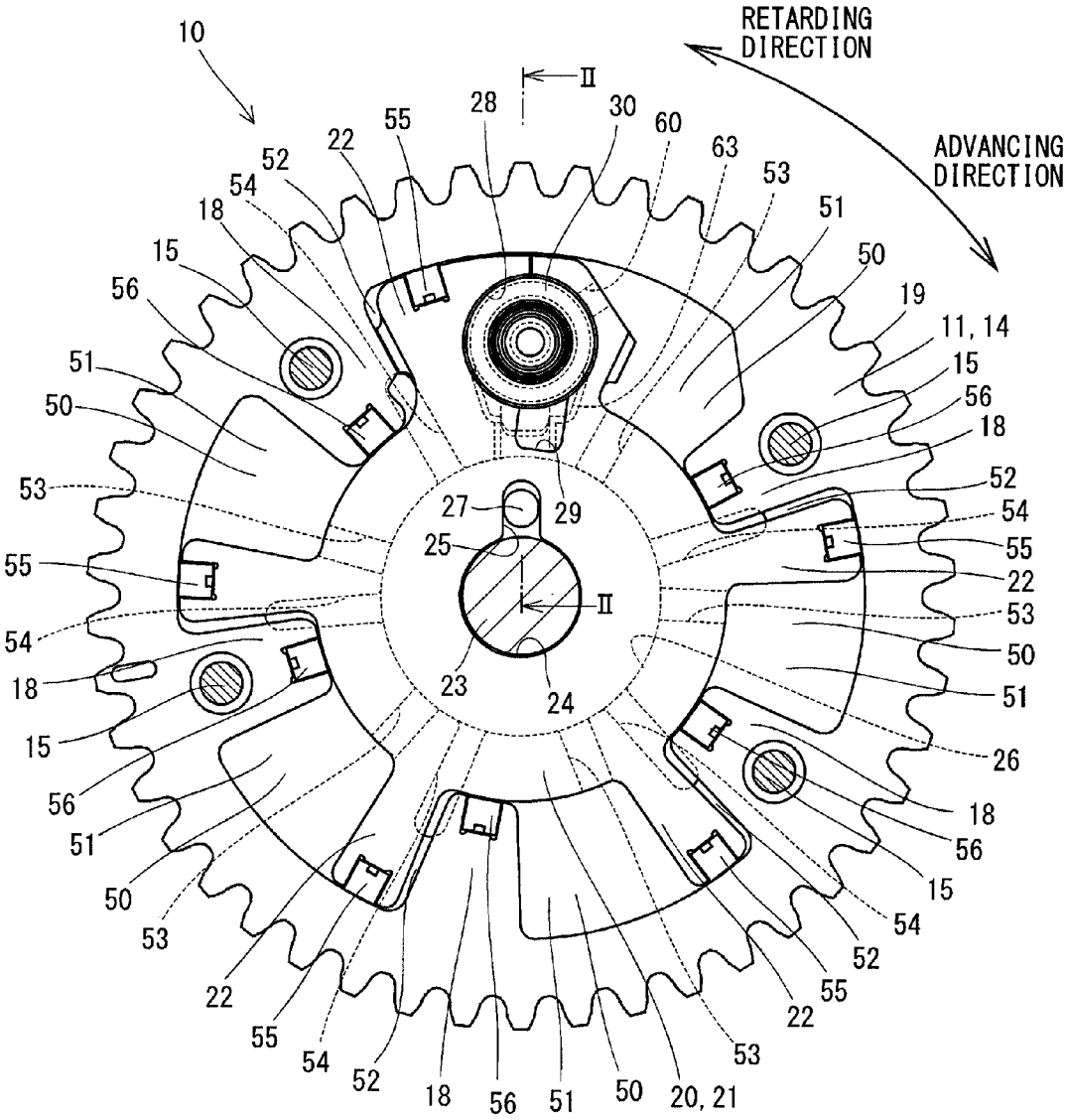
FIG. 3 is a cross sectional view taken along line in FIG. 2.

As shown in FIGS. 2 and 3, the valve timing control apparatus 10 includes a housing 11, the vane rotor 20, a lock pin 30 and an air discharge hole 100.

The housing 11 includes a front plate 12, a rear plate 13 and a peripheral wall 14. The rear plate 13 is opposed to the front plate 12. The peripheral wall 14 connects between the front plate 12 and the rear plate 13.

The front plate 12 is fixed to an axial side of the peripheral wall 14 with bolts 15. The front plate 12 has a hole 16 at a center of the front plate 12.

The rear plate 13 is fixed to another axial side of the peripheral wall 14, which is opposite from the front plate 12, with the bolts 15. The rear plate 13 has a hole 17 at a center of the rear plate 13 to receive the camshaft 4.

The peripheral wall 14 has a plurality of shoes (serving as partitioning members) 18, which radially inwardly project from an inner wall surface of the peripheral wall 14. The shoes 18 are arranged one after another in a circumferential direction of the peripheral wall 14. An oil pressure chamber 50 is formed between each circumferentially adjacent two of the shoes 18.

The peripheral wall 14 has the gear 19, which is placed on a radially outer side of an outer wall surface of the peripheral wall 14. The chain 7 is wound around the gear 19 to transmit the torque from the crankshaft 2 to the housing 11.

The vane rotor 20 is received in an inside of the housing 11 such that the vane rotor 20 is rotatable relative to the housing 11. The vane rotor 20 includes a rotor 21 and a plurality of vanes 22. The rotor 21 is shaped into a cylindrical tubular form, and the vanes 22 radially outwardly project from an outer wall of the rotor 21.

The rotor 21 has a bolt hole 24 at a center of the rotor 21 to receive a center bolt 23. The rotor 21 also has a positioning recess 25, which is radially outwardly recessed from the bolt hole 24. Furthermore, the rotor 21 has a camshaft receiving hole 26, which extends from an axial intermediate point toward the rear plate 13 side in the rotor 21 to receive the camshaft 4.

The rotor 21 and the camshaft 4 are fixed together with the center bolt 23. A head 231 of the center bolt 23 is placed on a radially inner side of the hole 16 of the front plate 12. A positioning pin 27, which is press fitted into the camshaft 4, contacts an inner wall of the positioning recess 25 of the rotor 21, so that the camshaft 4 and the rotor 21 are positioned relative to each other in the rotational direction. In this way, the vane rotor 20 is rotated together with the camshaft 4.

The camshaft 4 has a first oil groove 41 and a second oil groove 42, which circumferentially extend in a portion of an outer wall of the camshaft 4, which is inserted into the valve timing control apparatus 10. A first oil passage 45 and a second oil passage 46, which conduct oil pumped from an oil pan 43 by an oil pump 44, are formed at the engine 1 side. The first oil groove 41 of the camshaft 4 is communicated with the first oil passage 45 of the engine 1 side through a first hole 47 that extends in the axial direction of the camshaft 4. The second oil groove 42 of the camshaft 4 is communicated with the second oil passage 46 of the engine 1 side through a second hole 48 that extends in the axial direction of the camshaft 4.

Each of the vanes 22 partitions a corresponding one of the oil pressure chambers 50 into a retarding chamber 51 and an advancing chamber 52. The vane rotor 20 has a plurality of retarding passages 53, each of which communicates between the first oil groove 41 of the camshaft 4 and a corresponding one of the retarding chambers 51. The vane rotor 20 has a plurality of advancing passages 54, each of which communicates between the second oil groove 42 of the camshaft 4 and a corresponding one of the advancing chambers 52.

When the oil, which is pumped from the oil pan 43 by the oil pump 44, is supplied to the retarding chambers 51 through an oil pressure control valve 49, the first oil passage 45, the first hole 47, the first oil groove 41 and the retarding passages 53, the oil of the advancing chambers 53 is discharged to the oil pan 43 through the advancing passages 54, the second oil groove 42, the second hole 48, the second oil passage 46 and the oil pressure control valve 49. In this way, the oil pressure, which is supplied to each of the retarding chambers 51, is exerted against the corresponding one of the vanes 22, so that the rotational phase of the vane rotor 20 is controlled in a retarding direction relative to the housing 11.

When the oil pressure control valve 49 switches the flow passages to connect the oil pump 44 to the second oil passage 46, the oil, which is pumped by the oil pump 44, is supplied to the advancing chambers 52 through the oil pressure control valve 49, the second oil passage 46, the second hole 48, the second oil groove 42 and the advancing passages 54, and thereby the oil of the retarding chambers 51 is discharged to the oil pan 43 through the retarding passages 53, the first oil groove 41, the first hole 47, the first oil passage 45 and the oil pressure control valve 49. In this way, the oil pressure, which is supplied to each of the advancing chambers 52, is exerted against the corresponding one of the vanes 22, so that the rotational phase of the vane rotor 20 is controlled in an advancing direction relative to the housing 11.

Each of seal members 55 is installed between a radially outer wall of a corresponding one of the vanes 22 and the inner wall surface of the peripheral wall 14. Each of seal members 56 is installed between a radially inner wall of a corresponding one of the shoes 18 and a radially outer wall of the rotor 21. The seal members 55, each of which is installed to the radially outer wall of the corresponding one of the vanes 22, are urged against the peripheral wall 14. The seal members 56, each of which is installed to the radially inner wall of the corresponding one of the shoes 18, are urged against the rotor 21. Thereby, the seal members 55, 56 limit leakage of the oil between the corresponding retarding chamber 51 and the corresponding advancing chamber 52.

The vane rotor 20 has a receiving hole 28, which is shaped into a cylindrical form and extends in parallel with the rotational axis of the vane rotor 20. The receiving hole 28 extends through the vane rotor 20. The lock pin 30 is shaped into a tubular form having a bottom and is axially reciprocatably received in the inside of the receiving hole 28.

The rear plate 13 has a fitting hole 31 that is placed in a corresponding position that corresponds to a position of the lock pin 30 in a state where the vane rotor 20 is phase controlled to the most retarded angular position thereof. A ring member 32 is placed in an inside of the fitting hole 31. An end portion of the lock pin 30, which is placed on the rear plate 13 side, is insertable into an inside of the ring member 32.

The lock pin 30 has a spring hole 33, which is axially recessed from the front plate 12 side end surface of the lock pin 30 toward the rear plate 13 side. A spring 34 is received in the spring hole 33. One end of the spring 34 contacts an inner wall of the spring hole 33, and another end of the spring 34 contacts an inner wall of the front plate 12. The spring 34 urges the lock pin 30 toward the rear plate 13 side.

A back pressure hole 36 is formed in the front plate 12. The back pressure hole 36 communicates a back pressure chamber 35, which is formed between the lock pin 30 and the front plate 12 at the time of fitting the lock pin 30 into the fitting hole 31, to the atmosphere. The vane rotor 20 has a back pressure communicating groove 29, which communicates between the back pressure chamber 35 and the back pressure hole 36 when the lock pin 30 is inserted into the fitting hole 31. In the state where the lock pin 30 is inserted into the fitting hole 31, the spring hole 33 opens to the atmosphere through the back pressure communicating groove 29 and the back pressure hole 36. Thereby, at the time of removing the lock pin 30 from the fitting hole 31, the oil pressure can be removed from the back pressure chamber 35 through the back pressure communicating groove 29 and the back pressure hole 36. Thus, the lock pin 30 is appropriately operated.

The receiving hole 28 is configured such that an inner diameter of the front plate 12 side portion of the receiving hole 28 is larger than an inner diameter of the rear plate 13 side portion of the receiving hole 28. In contrast, the lock pin 30 is configured such that an outer diameter of the front plate 12 side portion of the lock pin 30 is larger than an outer diameter of the rear plate 13 side portion of the lock pin 30. A first pressure chamber 61 is formed by the inner wall of the front plate 12 side portion of the receiving hole 28, which has the large inner diameter, and the outer wall of the lock pin 30. The first pressure chamber 61 is communicated with the corresponding retarding chamber 51 through an oil passage 60 (see FIG. 3) that is formed in one of the vanes 22. The oil pressure, which is supplied to the first pressure chamber 61, is applied to the lock pin 30 in a removing direction, which is a direction for removing the lock pin 30 from the fitting hole 31 and is opposite from an inserting direction of the lock pin 30.

The second pressure chamber 62 is formed between the rear plate 13 side end surface of the lock pin 30 and a bottom of the fitting hole 31. The second pressure chamber 62 is communicated with the second oil groove 42 through a passage 63 that is formed in the rear plate 13. The oil pressure, which is supplied to the second pressure chamber 62, is also applied to the lock pin 30 in the removing direction. When a sum of a force of the oil pressure, which is supplied to the first pressure chamber 61 and is applied to the lock pin 30 in the removing direction, and a force of the oil pressure, which is supplied to the second pressure chamber 62 and is applied to the lock pin 30 in the removing direction, becomes larger than a resilient force (an urging force) of the spring 34, the lock pin 30 is removed from the fitting hole 31.

An axially projected surface area of an exposed portion of the lock pin 30, which is exposed in the second pressure chamber 62, is larger than an axially projected surface area of an exposed portion of the lock pin 30, which is exposed in the first pressure chamber 61. Therefore, even when the oil pressure, which is supplied to the first pressure chamber 61, is equal to the oil pressure, which is supplied to the second pressure chamber 62, the oil pressure, which is supplied to the second pressure chamber 62, provides a larger drive force for driving the lock pin 30 in the removing direction in comparison to the oil pressure, which is supplied to the first pressure chamber 61.

A pin passage 37 is formed in the lock pin 30. One side of the pin passage 37 forms one opening of the pin passage 37 that opens in a predetermined location of an outer wall of the lock pin 30, which is located at a radially outer side. Another side of the pin passage 37 forms another opening of the pin passage 37 that opens in an inner wall of the spring hole 33 (i.e., opens to the atmosphere side). Furthermore, a rotor passage 38 is formed in the vane rotor 20. One side of the rotor passage 38 forms one opening of the rotor passage 38 that opens in the inner wall of the receiving hole 28.

Another side of the rotor passage 38 forms another opening of the rotor passage 38 that opens to the passage 63, which is communicated with the second pressure chamber 62. As discussed above, in the state where the lock pin 30 is inserted into the fitting hole 31, the spring hole 33 opens to the atmosphere through the back pressure communicating groove 29 and the back pressure hole 36.

In the present embodiment, the pin passage 37, the spring hole 33 and the rotor passage 38 form the air discharge hole 100.

The lock pin 30 includes a first slidable portion 301 that is formed in the outer wall of the lock pin 30 at a location between a portion of the outer wall of the lock pin 30, which forms the first pressure chamber 61, and the opening of the pin passage 37. The lock pin 30 also includes a second slidable portion 302 that is formed in the outer wall of the lock pin 30 at a location between another portion of the outer wall of the lock pin 30, which forms the second pressure chamber 62, and the opening of the pin passage 37. The first slidable portion 301 and the second slidable portion 302 slidably contact the inner wall of the receiving hole 28.

That is, in the radially outer wall of the lock pin 30, the opening of the pin passage 37 is formed between the first slidable portion 301 and the second slidable portion 302.

Figure 4:
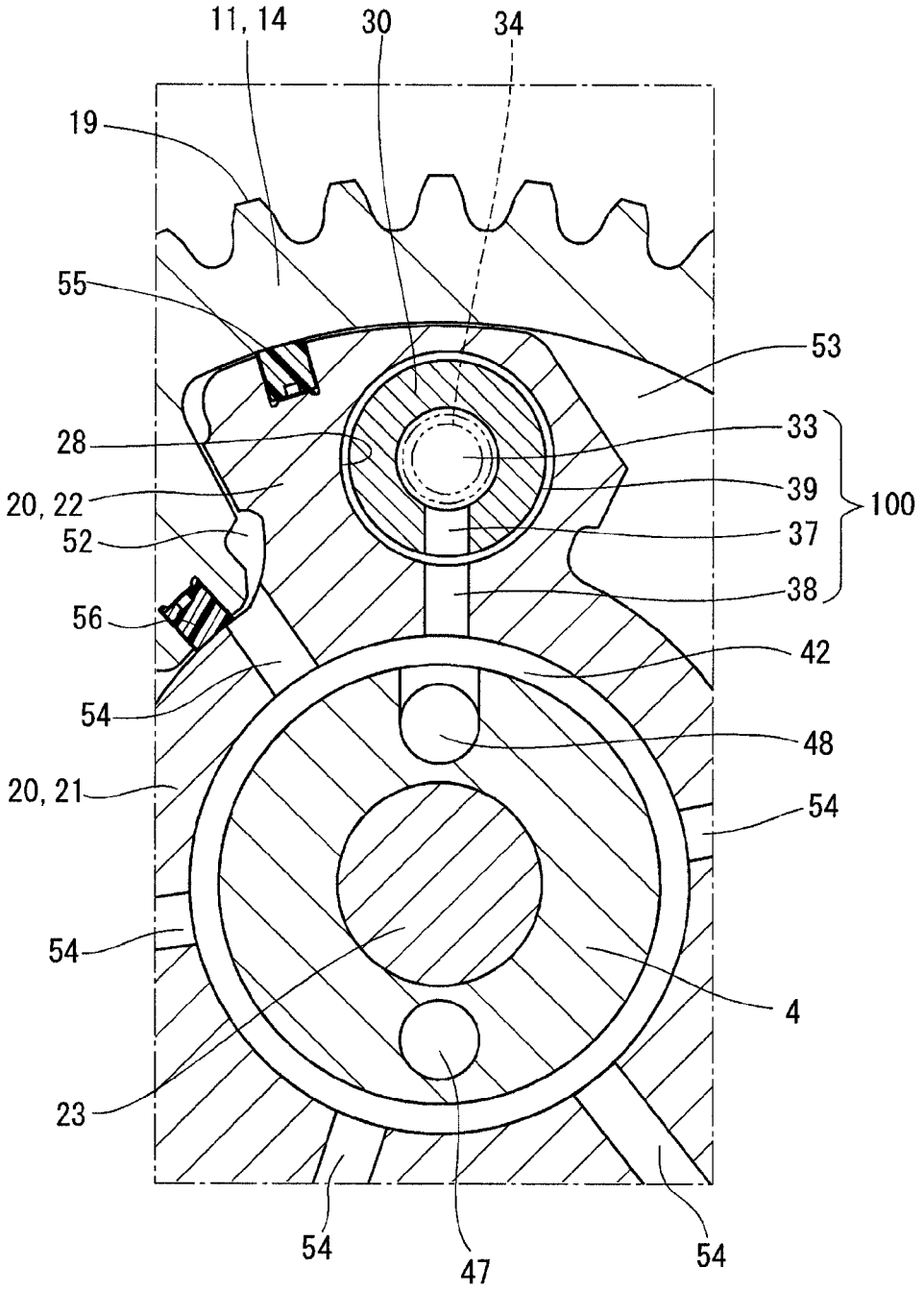
FIG. 4 is an enlarged cross-sectional view taken along line IV-IV in FIG. 2.

As shown in FIG. 2, in the state where the lock pin 30 is inserted into the fitting hole 31, the pin passage 37 and the rotor passage 38 are communicated with each other. In this way, the second pressure chamber 62 opens to the atmosphere through the passage 63, the rotor passage 38, the pin passage 37, the spring hole 33, the back pressure communicating groove 29 and the back pressure hole 36. As shown in FIGS. 2 and 4, the lock pin 30 has a groove 39 that extends in the circumferential direction at the portion of the outer wall of the lock pin 30, at which the pin passage 37 is formed. In this way, even when the lock pin 30 is rotated about the axis, the communication between the pin passage 37 and the rotor passage 38 is maintained.

The pin passage 37 has a flow passage cross-sectional area that is set to have a predetermined flow passage resistance. The predetermined flow passage resistance is a flow passage resistance that enables increasing of the oil pressure of the second pressure chamber 62 by the oil pressure supplied to the second pressure chamber 62. In this way, although the air, which flows into the second pressure chamber 62, flows to the atmosphere through the pin passage 37, the flow of the oil, which is supplied to the second pressure chamber 62, is resisted due to the fact of that the pin passage 37 acts as the flow passage resistance. Thereby, the oil, which is supplied to the second pressure chamber 62, applies the oil pressure to the lock pin 30 in the removing direction for removing the lock pin 30 from the fitting hole 31.

Figure 5:
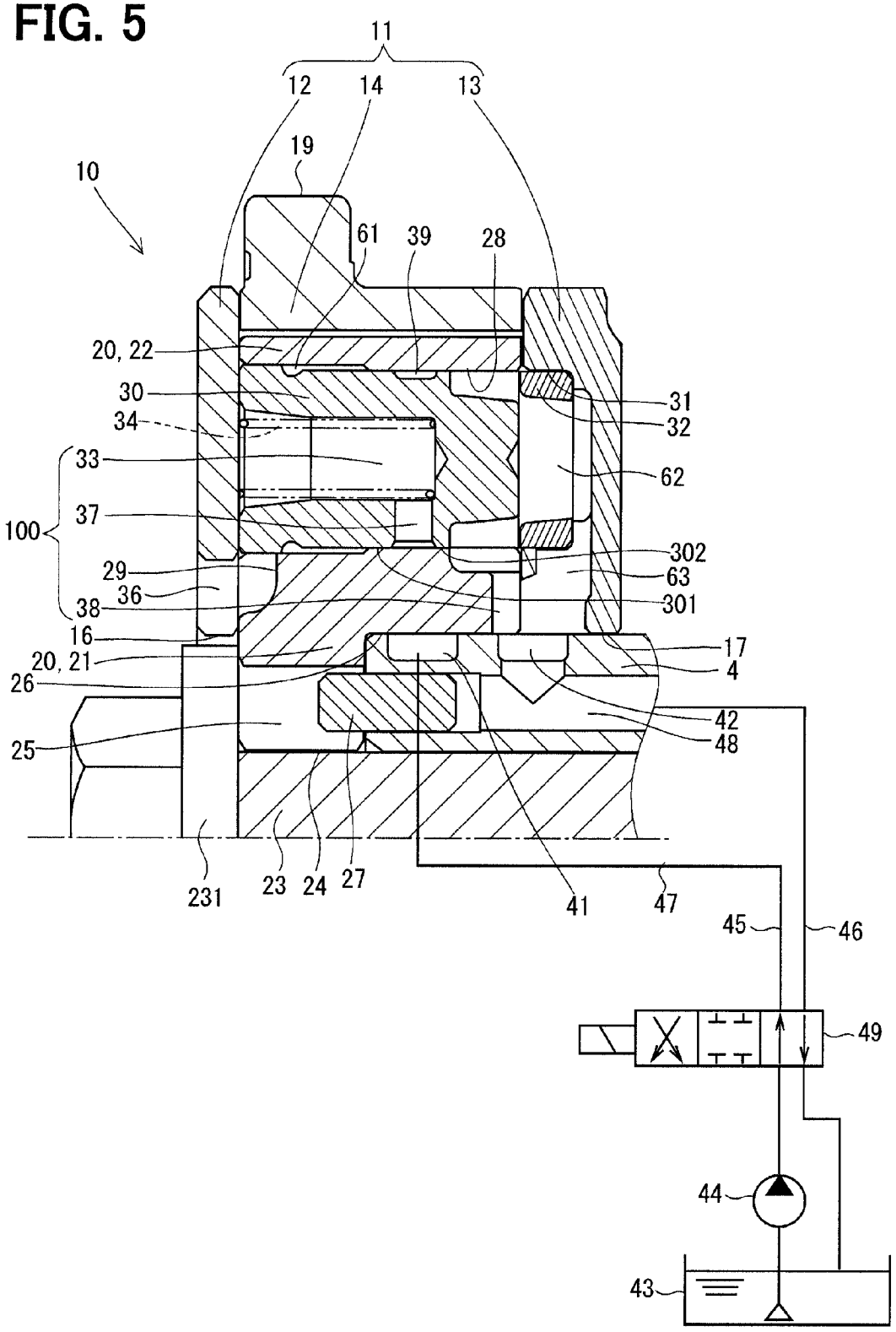
FIG. 5 is a cross-sectional view of the valve timing control apparatus of the first embodiment, showing the lock pin removed from the fitting hole.

In contrast, as shown in FIG. 5, in the state where the lock pin 30 is removed from the fitting hole 31, the location of the one opening of the pin passage 37, which is formed in the radially outer wall of the lock pin 30, is displaced from the location of the one opening of the rotor passage 38, which is formed in the inner wall of the receiving hole 28, in the axial direction (the reciprocating direction of the lock pin 30). In this way, the opening of the pin passage 37 in the radially outer wall of the lock pin 30 is closed by the inner wall of the receiving hole 28. At this time, the flow of the oil between the pin passage 37 and the first pressure chamber 61 is blocked by the first slidable portion 301. Furthermore, the flow of the oil between the pin passage 37 and the second pressure chamber 62 is blocked by the second slidable portion 302. Thus, when the lock pin 30 is removed from the fitting hole 31, the communication between the second pressure chamber 62 and the atmosphere through the air discharge hole 100 is blocked.

Next, the operation of the valve timing control apparatus 10 will be described.

<Time of Engine Stop>

As shown in FIGS. 2 and 3, when the engine 1 is in the stop state, the lock pin 30 is inserted into the inside of the ring member 32 in the fitting hole 31, so that the rotational phase of the vane rotor 20 is maintained at the most retarded position.

<Time of Engine Start>

In a state immediately after the starting of the engine 1, the oil, which is pumped from the oil pan 43 by the oil pump 44, is supplied to the retarding chambers 51 through the oil pressure control valve 49, the first oil passage 45, the first hole 47, the first oil groove 41 and the retarding passages 53. At this time, in the normal state, the air, which is accumulated in the section from the first oil passage 45 to the retarding chambers 51, flows to the advancing chambers 52 through the gap between the housing 11 and the vane rotor 20 and is discharged from the advancing chambers 52 to the oil pan 43 side through the advancing passages 54, the second oil groove 42, the second hole 48, the second oil passage 46 and the oil pressure control valve 49.

The lock pin 30 maintains the inserted state, in which the lock pin 30 is inserted into the fitting hole 31, from the time point immediately after starting the engine 1 until the sufficient oil pressure is supplied to the retarding chambers 51, the advancing chambers 52, the first pressure chamber 61 and the second pressure chamber 62. Therefore, collisions between the housing 11 and the vane rotor 20 caused by the transmission of the cam torque from the camshaft 4 can be limited.

Now, there will be discussed about a state where the second oil passage 46 at the engine 1 side is nearly clogged upon increasing of the viscosity of the oil under the extremely low temperature, or a state where the second oil passage 46 is clogged by, for example, a foreign object. In such a case, when the oil, which is pumped by the oil pump 44, is supplied to the retarding chambers 51 in the manner discussed above, the air, which is accumulated in the section from the first oil passage 45 to the retarding chambers 51, flows into the advancing chambers 52 and the second pressure chamber 62 through, for example, the gap between the housing 11 and the vane rotor 20. At this time, the gas pressure of the second pressure chamber 62 will be increased to cause removal of the lock pin 30 from the fitting hole 31 unless the air is discharged from the advancing chambers 52 and the second pressure chamber 62. However, according to the present embodiment, the air, which flows into the second pressure chamber 62, is discharged to the atmosphere from the passage 63, which is communicated with the second pressure chamber 62, through the air discharge hole 100. Therefore, the gas pressure of the second pressure chamber 62 will not be increased, and thereby the lock pin 30 maintains the inserted state where the lock pin 30 is inserted into the fitting hole 31. Thus, generation of hitting sound caused by the collision between the housing 11 and the vane rotor 20 is limited.

<After Engine Start>

After the star of the engine 1, the oil, which is supplied from the oil pump 44 to the retarding chambers 51, fills the first pressure chamber 61 and also fills the advancing chambers 52 and the second pressure chamber 62 after passing through, for example, the gap between the housing 11 and the vane rotor 20. At this time, the pin passage 37 serves as the flow passage resistance, so that the oil pressure of the second pressure chamber 62 is increased. When the force, which is exerted by the oil pressure of the first pressure chamber 61 and the oil pressure of the second pressure chamber 62 upon increasing of the oil pressure supplied from the oil pump 44, becomes larger than the urging force of the spring 34, the lock pin 30 is removed from the fitting hole 31, as shown in FIG. 5. In this state, the flow of the oil between the second pressure chamber 62 and the pin passage 37 is blocked. Thus, releasing of the oil pressure of the advancing chambers 52 and the oil pressure of the second pressure chamber 62, which is communicated with the advancing chambers 52, to the atmosphere from the passage 63, which is communicated with the second pressure chamber 62, through the air discharge hole 100 is limited. Thus, the valve timing control apparatus 10 can ensure the sufficient response speed of the advancing control operation and the sufficient response speed of the retarding control operation, and the relative rotational phase between the housing 11 and the vane rotor 20 can be accurately adjusted by the valve timing control apparatus 10.

<Time of Advancing Control Operation>

At the time of executing the advancing control operation of the valve timing control apparatus 10, the oil pressure control valve 49 switches the oil passages such that the oil pressure control valve 49 connects the oil pump 44 to the second oil passage 46 and also connects the first oil passage 45 to the oil pan 43. The oil, which is supplied from the oil pump 44, is supplied to the advancing chambers 52 through the second oil passage 46, the second hole 48, the second oil groove 42 and the advancing passages 54. In contrast, the oil of the retarding chambers 51 is discharged to the oil pan 43 through the retarding passages 53, the first hole 47, the first oil groove 41 and the first oil passage 45. The oil pressure of the advancing chambers 52 is applied to the vanes 22 to generate the torque that urges the vane rotor 20 in the advancing direction. Thereby, the vane rotor 20 is rotated relative to the housing 11 in the advancing direction.

<Time of Retarding Control Operation>

At the time of executing the retarding control operation of the valve timing control apparatus 10, the oil pressure control valve 49 switches the oil passages such that the oil pressure control valve 49 connects the oil pump 44 to the first oil passage 46 and also connects the second oil passage 46 to the oil pan 43. The oil, which is supplied from the oil pump 44, is supplied to the retarding chambers 51 through the first oil passage 45, the first hole 47, the first oil groove 41 and the retarding passages 53. In contrast, the oil of the advancing chambers 52 is discharged to the oil pan 43 through the advancing passages 54, the second hole 48, the second oil groove 42 and the second oil passage 46. The oil pressure of the retarding chambers 51 is applied to the vanes 22 to generate the torque that urges the vane rotor 20 in the retarding direction. Thereby, the vane rotor 20 is rotated relative to the housing 11 in the retarding direction.

<Time of Intermediate Holding Operation>

When the vane rotor 20 reaches a target rotational phase, the oil pressure control valve 49 blocks the connection of the oil pump 44 to both of the first oil passage 45 and the second oil passage 46 and limits the discharge of the oil (working oil) from both of the retarding chambers 51 and the advancing chambers 52 to the oil pan 43. Thereby, the vane rotor 20 is held in the target phase.

<Time of Engine Stop>

When the engine stop is commanded in the middle of operating the valve timing control apparatus 10, the vane rotor 20 is rotated relative to the housing 11 in the retarding direction and is thereby phase controlled to the most retarded position. After the commanding of the engine stop, when the oil pressure supplied to the valve timing control apparatus 10 is progressively reduced in response to the reduction of the rotational speed of the engine 1, the oil pressure of the first pressure chamber 61 and the oil pressure of the second pressure chamber 62 are also reduced. Thereby, the lock pin 30 is inserted into the fitting hole 31 by the urging force of the spring 34.

The valve timing control apparatus 10 of the present embodiment provides the following advantages.

(1) In the present embodiment, the air discharge hole 100, which includes the pin passage 37 formed in the lock pin 30, can discharge the air, which is conducted from the retarding chambers 51 to the advancing chambers 52 and the second pressure chamber 62, to the atmosphere. Thus, even in the case where the engine side oil passage, which discharges the oil from the advancing chambers 52, is clogged, the removal of the lock pin 30 from the fitting hole 31 by the pressure of the air conducted to the second pressure chamber 62 is limited. Therefore, the valve timing control apparatus 10 can limit the generation of the noise (hitting noise) at the time of starting the engine 1.

Furthermore, the air discharge hole 100 blocks the communication of the second pressure chamber 62 to the atmosphere in the state where the lock pin 30 is removed from the fitting hole 31. Therefore, at the time of executing the advancing control operation and the retarding control operation of the valve timing control apparatus 10, the discharge of the oil through the air discharge hole 100 can be limited. Thus, the valve timing control apparatus 10 can ensure the sufficient response speed of the advancing control operation and the sufficient response speed of the retarding control operation, and the relative rotational phase between the housing 11 and the vane rotor 20 can be accurately adjusted by the valve timing control apparatus 10.

(2) In the present embodiment, the opening of the pin passage 37, which opens in the radially outer wall of the lock pin 30, is communicated with the rotor passage 38 in the state where the lock pin 30 is inserted into the fitting hole 31. Furthermore, the opening of the pin passage 37, which opens in the radially outer wall of the lock pin 30, is closed by the inner wall of the receiving hole 28 in the state where the lock pin 30 is removed from the fitting hole 31.

Thereby, the pin passage 37 and the rotor passage 38 of the air discharge hole 100 can block the communication between the second pressure chamber 62 and the atmosphere at the time of removing the lock pin 30 from the fitting hole 31.

(3) In the present embodiment, the air discharge hole 100 communicates between the second pressure chamber 62 and the atmosphere in the state where the lock pin 30 is inserted into the fitting hole 31. Furthermore, the air discharge hole 100 blocks the communication between the second pressure chamber 62 and the atmosphere in the state where the lock pin 30 is removed from the fitting hole 31.

In this way, when the oil pressure is supplied to the retarding chambers 51 at the time of starting the engine 1, the valve timing control apparatus 10 can limit the removal of the lock pin 30 from the fitting hole 31 caused by the air, which is accumulated in the retarding chambers 51, the advancing chambers 52 and the second pressure chamber 62 at the time of engine stop.

(4) In the present embodiment, the lock pin 30 has the first slidable portion 301, which is formed between the first pressure chamber 61 and the opening of the pin passage 37, and the second slidable portion 302, which is formed between the second pressure chamber 62 and the pin passage 37.

In this way, in the state where the lock pin 30 is removed from the fitting hole 31, the communication of the pin passage 37 to the first pressure chamber 61 and the second pressure chamber 62 can be limited.

(5) In the present embodiment, the pin passage 37 opens in the inner wall of the spring hole 33.

In this way, the structure of the air discharge hole 100 can be simplified by using the spring hole 33, which opens to the atmosphere in the state where the lock pin 30 is inserted into the fitting hole 31.

(6) In the present embodiment, the flow passage cross-sectional area of the air discharge hole 100 is set to the corresponding size that enables the increase of the oil pressure of the second pressure chamber 62.

In this way, the valve timing control apparatus 10 can discharge the air from the air discharge hole 100 and can reliably release the lock pin 30 from the fitting hole 31 by largely setting the oil pressure loss with the air discharge hole 100.

Second Embodiment

Figure 6:
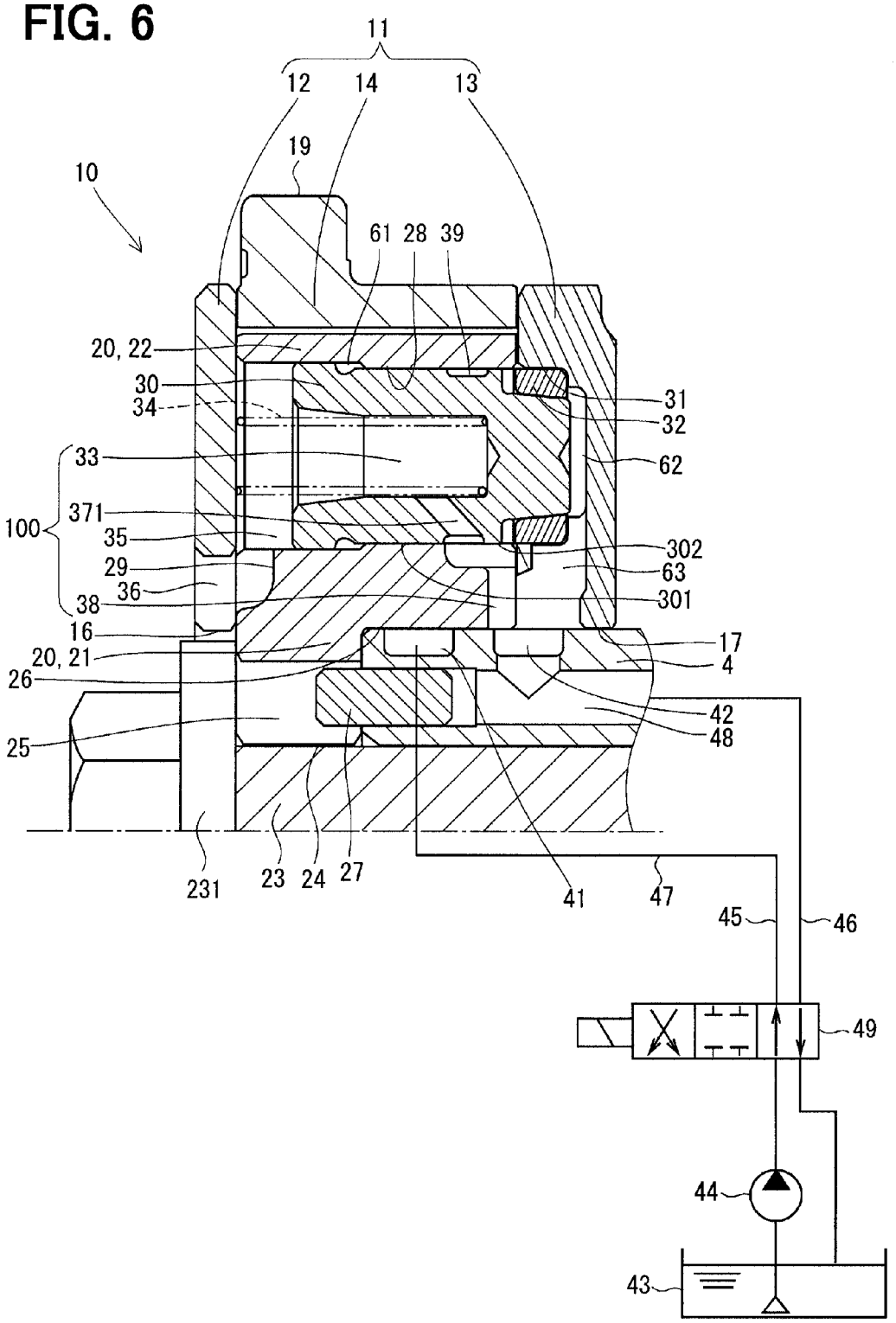
FIG. 6 is a cross-sectional view of a valve timing control apparatus according to a second embodiment of the present disclosure.

Next, a second embodiment of the present disclosure will be described with reference to FIG. 6. In the following embodiments, the components, which are similar to those of the first embodiment, will be indicated by the same reference signs and will not be described again for the sake of simplicity.

In the second embodiment, the pin passage 371, which is formed in the lock pin 30, is tilted relative to the rotational axis of the vane rotor 20. Even with this structure, the air discharge hole 100 has the same function as the air discharge hole 100 of the first embodiment discussed above. Thus, the valve timing control apparatus 10 of the second embodiment achieves the same advantages as those of the first embodiment.

Third Embodiment

A third embodiment of the present disclosure will be described with reference to FIGS. 7 and 8. In the third embodiment, the pin passage 372, which is formed in the lock pin 30 to extend in the axial direction, communicates between the second pressure chamber 62 and the spring hole 33.

Figure 7:
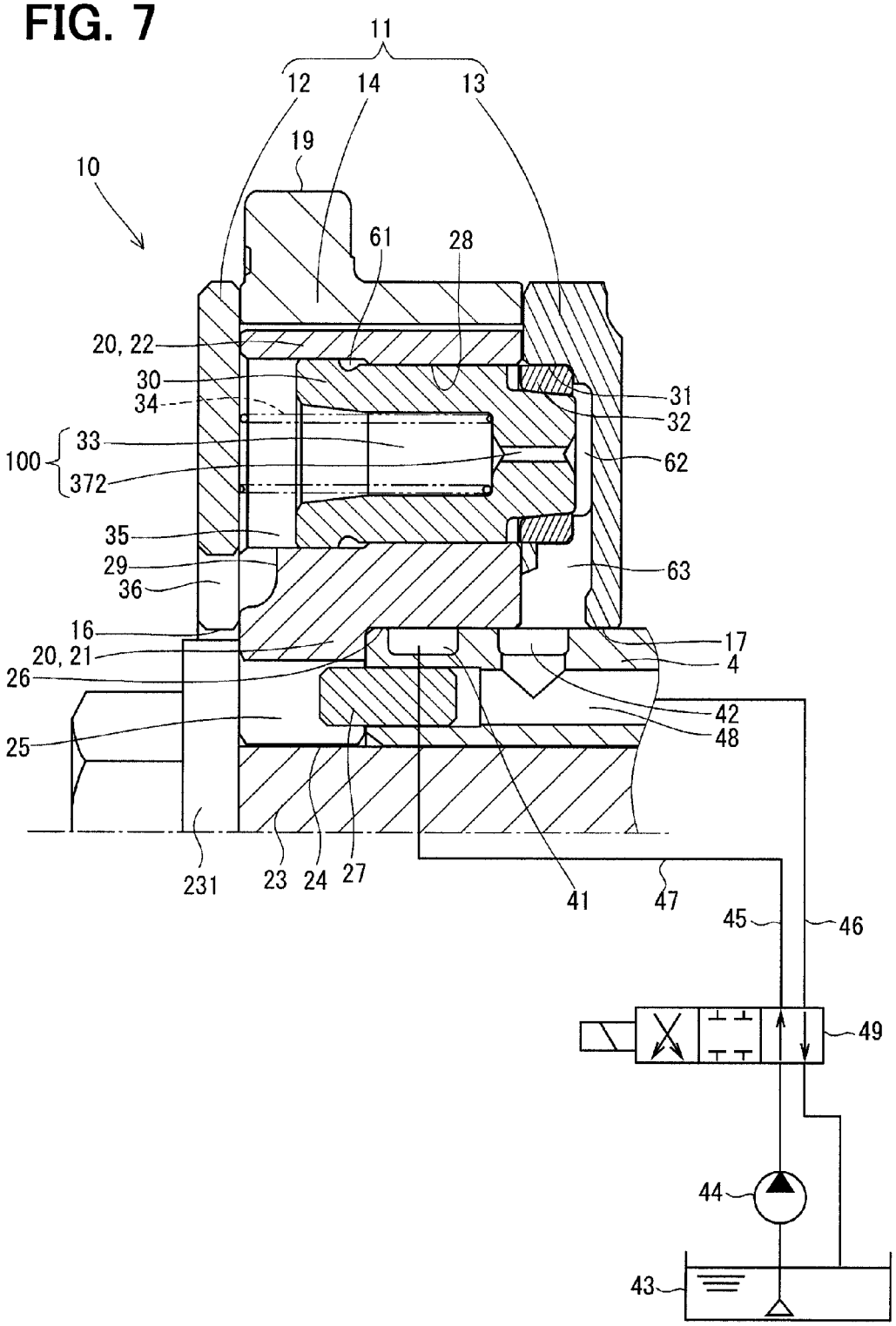
FIG. 7 is a cross-sectional view of a valve timing control apparatus according to a third embodiment of the present disclosure, showing a lock pin inserted into a fitting hole.

Even with this structure, as shown in FIG. 7, in the state where the lock pin 30 is inserted into the fitting hole 31, the second pressure chamber 62 opens to the atmosphere through the pin passage 372, the spring hole 33, the back pressure communicating groove 29 and the back pressure hole 36.

Figure 8:
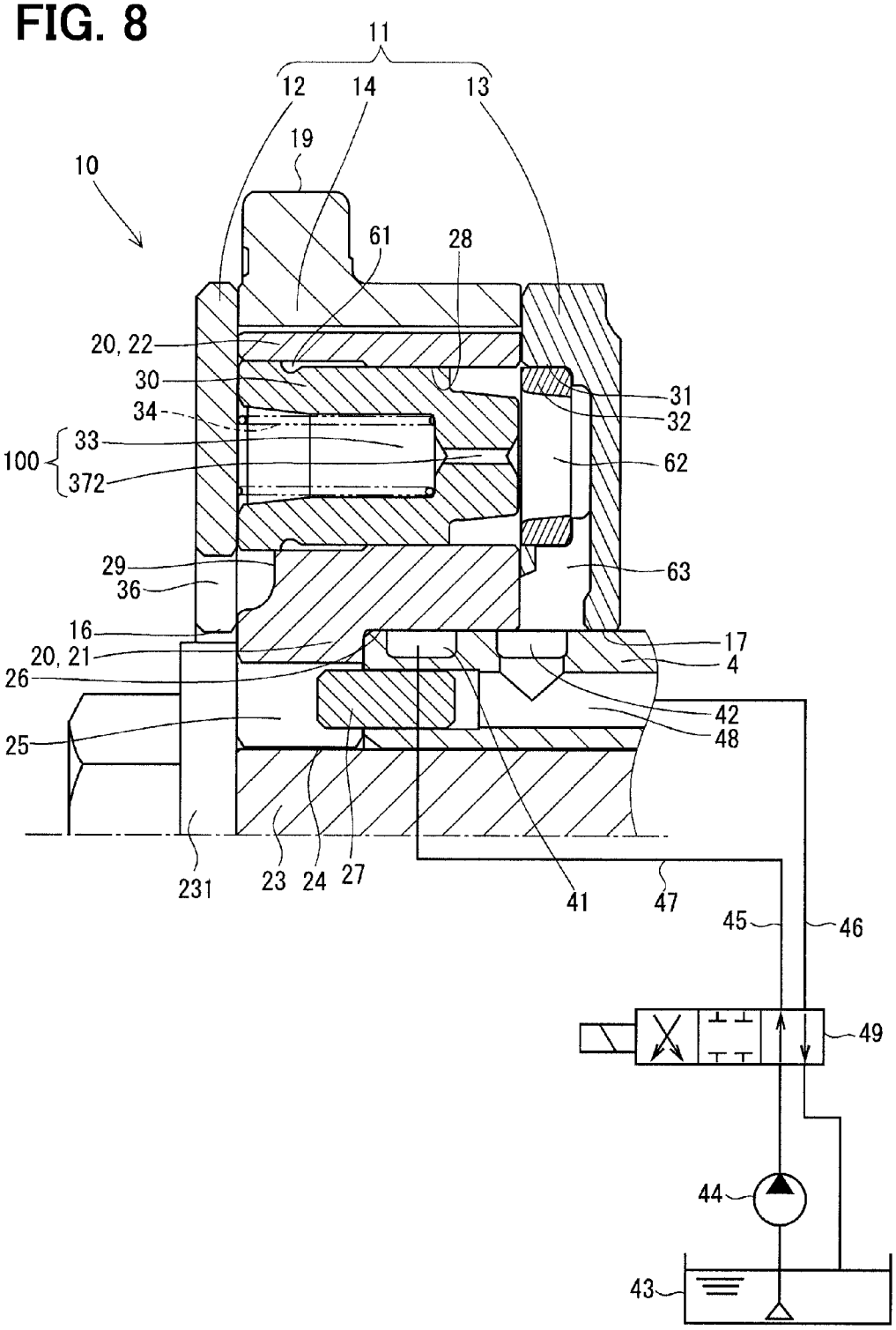
FIG. 8 is a cross-sectional view of the valve timing control apparatus of the third embodiment, showing the lock pin removed from the fitting hole.

In contrast, as shown in FIG. 8, in the state where the lock pin 30 is removed from the fitting hole 31, the lock pin 30 contacts the front plate 12. In this way, the communication between the spring hole 33 and the atmosphere is blocked. Thus, the communication of the second pressure chamber 62 to the atmosphere is blocked. Thereby, the valve timing control apparatus 10 of the third embodiment achieves the same advantages as those of the first and second embodiments.

Fourth Embodiment

Figure 9:
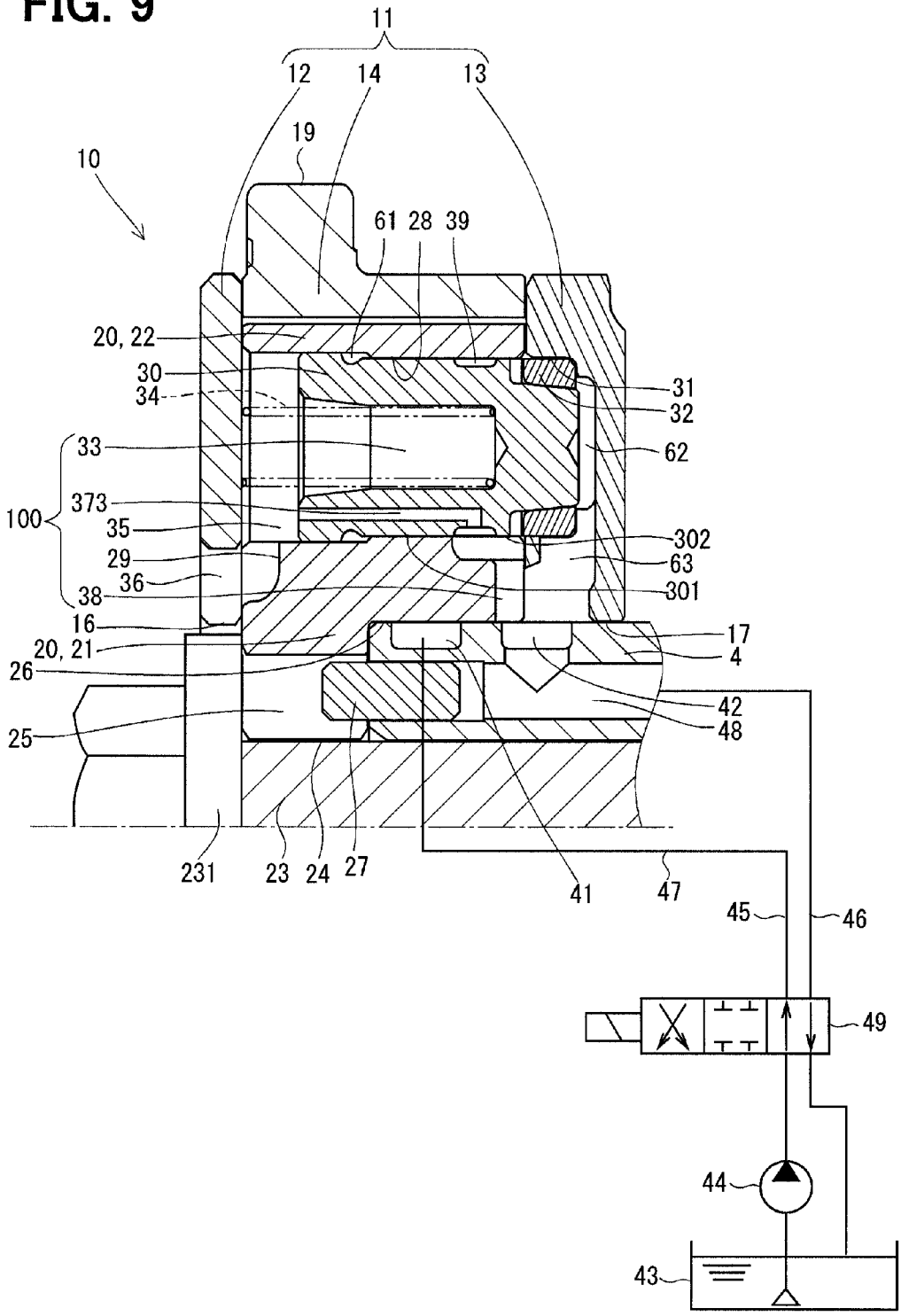
FIG. 9 is a cross sectional view of a valve timing control apparatus according to a fourth embodiment of the present disclosure.

A fourth embodiment of the present disclosure will be described with reference to FIG. 9. In the fourth embodiment, one side of the pin passage 373 opens in the radially outer wall of the lock pin 30, and another side of the pin passage 373 opens in the front plate 12 side outer wall of the lock pin 30. Thus, in the fourth embodiment, the air discharge hole 100 is formed by the pin passage 373 and the rotor passage 38 without using the spring hole 33.

The valve timing control apparatus 10 of the fourth embodiment provides the same advantages as those of the first to third embodiments.

Other Embodiments (1) In the above embodiments, the valve timing control apparatus 10, which adjusts the valve timing (opening timing and closing timing) of the intake valves 8, is described. Alternatively, in another embodiment, the valve timing control apparatus 10 may adjust the valve timing (opening timing and closing timing) of the exhaust valves 9.

(2) In the above embodiments, the fitting hole 31, into which the lock pin 30 is inserted, is formed in the rear plate 13. In another embodiment, alternative to the above construction, the lock pin 30 may be inserted into a fitting hole formed in the front plate 12.

(3) In the above embodiments, the front plate 12, the rear plate 13 and the peripheral wall 14 are formed by the separate members, respectively. Alternatively, in another embodiment, the front plate 12, the rear plate 13 and the peripheral wall 14 may be formed such that adjacent members are integrally formed together.

The present disclosure is not limited to the above embodiments. That is, the above embodiments may be further modified in various ways without departing from the principle of the present disclosure.

What is claimed is:

1. A valve timing control apparatus that changes relative rotational phase between a drive shaft of an internal combustion engine and a driven shaft to adjust opening timing and closing timing of an intake valve or an exhaust valve, which is opened and closed by the driven shaft that is driven by the drive shaft, the valve timing control apparatus comprising:

a housing that includes:
- a front plate;
- a rear plate that is opposed to the front plate; and
- a peripheral wall that connects between the front plate and the rear plate, wherein the housing is rotated when a drive force of the drive shaft is conducted to the housing;

a vane rotor that includes:
- a rotor that is fixed to the driven shaft; and
- a vane that outwardly projects in a radial direction from the rotor and partitions an oil pressure chamber formed in an inside of the housing into an advancing chamber and a retarding chamber, wherein the vane rotor is rotatable relative to the housing;

a lock pin that is reciprocatable in an axial direction in an inside of a receiving hole, which extends through the vane rotor in the axial direction, wherein the lock pin is insertable into a fitting hole, which is formed in one of the front plate and the rear plate;

at least one pressure chamber that is communicated with the advancing chamber or the retarding chamber and receives an oil pressure that applies a force to the lock pin in a removing direction that is a direction for removing the lock pin from the fitting hole; and an air discharge hole, at least a portion of which is formed in the lock pin, wherein:

the air discharge hole communicates between the at least one pressure chamber and an atmosphere in a state where the lock pin is inserted into the fitting hole;

the air discharge hole blocks communication between the at least one pressure chamber and the atmosphere in a state where the lock pin is removed from the fitting hole;

the air discharge hole includes:

a pin passage that is formed in the lock pin, wherein one side of the pin passage forms one opening of the pin passage that opens in a predetermined location of an outer wall of the lock pin, which is located at a radially outer side, and another side of the pin passage forms another opening of the pin passage that opens to the atmosphere side; and a rotor passage that is formed in the vane rotor, wherein one side of the rotor passage forms one opening of the rotor passage that opens in an inner wall of the receiving hole, and another side of the rotor passage forms another opening of the rotor passage that is communicated with a passage, which is communicated with the at least one pressure chamber;

the one opening of the pin passage, which opens in the outer wall of the lock pin, is communicated with the rotor passage in the state where the lock pin is inserted into the fitting hole; and the one opening of the pin passage, which opens in the outer wall of the lock pin, is closed by the inner wall of the receiving hole in the state where the lock pin is removed from the fitting hole.

2. The valve timing control apparatus according to claim 1, wherein:

the pin passage is communicated with the rotor passage in the state where the lock pin is inserted into the fitting hole; and the pin passage is displaced from the rotor passage in a reciprocating direction of the lock pin in the state where the lock pin is removed from the fitting hole.

3. The valve timing control apparatus according to claim 2, wherein:

the at least one pressure chamber includes:

a first pressure chamber that receives the oil pressure when the oil pressure is supplied to one of the advancing chamber and the retarding chamber, to which the oil pressure is supplied at a time of starting the internal combustion engine; and a second pressure chamber that receives the oil pressure when the oil pressure is supplied to another one of the advancing chamber and the retarding chamber located on an opposite side relative to the one of the advancing chamber and the retarding chamber, to which the oil pressure is supplied at the time of starting the internal combustion engine; and the air discharge hole is placed at a location where the air discharge hole communicates between the second pressure chamber and the atmosphere in the state where the lock pin is inserted into the fitting hole, and the air discharge hole blocks communication between the second pressure chamber and the atmosphere in the state where the lock pin is removed from the fitting hole.

4. The valve timing control apparatus according to claim 3, wherein the lock pin has:

a first slidable portion that is formed in the outer wall of the lock pin at a location between one portion of the outer wall of the lock pin, which forms the first pressure chamber, and the one opening of the pin passage, wherein the first slidable portion slidably contacts an inner wall of the receiving hole; and a second slidable portion that is formed in the outer wall of the lock pin at a location between another portion of the outer wall of the lock pin, which forms the second pressure chamber, and the one opening of the pin passage, wherein the second slidable portion slidably contacts the inner wall of the receiving hole.

5. The valve timing control apparatus according to claim 1, further comprising a spring that is received in a spring hole, which is formed in the lock pin, wherein:

the air discharge hole includes the pin passage, the rotor passage and the spring hole; and the another opening of the pin passage opens in an inner wall of the spring hole and is openable to the atmosphere through the spring hole.

6. The valve timing control apparatus according to claim 1, where a flow passage cross-sectional area of the air discharge hole is set to a corresponding size that enables increasing of the oil pressure in the at least one pressure chamber such that the lock pin is removable from the fitting hole by the oil pressure supplied to the at least one pressure chamber.

* * * * *